US005733103A

United States Patent [19]

Wallace et al.

[11] Patent Number: 5,733,103

[45] Date of Patent: Mar. 31, 1998

[54] VIBRATION DAMPER FOR A TURBINE ENGINE

[75] Inventors: Thomas R. Wallace, Wyoming; Robyn E. Brands, West Chester, both of Ohio

[73] Assignee: General Electric Company, Cincinnati, Ohio

[21] Appl. No.: 768,263

[22] Filed: Dec. 17, 1996

[51] Int. Cl.[6] ..... F04D 29/18

[52] U.S. Cl. ..... 416/248; 416/500

[58] Field of Search ..... 416/248, 500

[56] References Cited

U.S. PATENT DOCUMENTS 4,171,930 10/1979 Brisken et al. ..... 415/500
4,192,633 3/1980 Herzner .
4,361,213 11/1982 Landis, Jr. et al. .
4,817,455 4/1989 Buxe .
4,848,182 7/1989 Novotny ..... 416/500

*Primary Examiner*—John T. Kwon
*Attorney, Agent, or Firm*—Andrew C. Hess; Nathan D. Herkamp

[57] ABSTRACT

A damper which, in one form, includes a damper ring having inner and outer radial surfaces, axial retainers extending radially outward from the outer radial surface, and an annular stiffener protruding radially inward from the inner radial surface, is described. The axial retainers prevent disengagement of the damper ring from the structural member. The stiffener adds mass to the damper ring such that the radial distance of the neutral axis of the damper ring from the neutral axis of the structural member is increased, thus increasing damping effectiveness. The stiffener also adds torsional and bending rigidity to the damper ring so that the damper ring is further prevented from disengaging from the structural member.

17 Claims, 6 Drawing Sheets

VIBRATION DAMPER FOR A TURBINE ENGINE

GOVERNMENT RIGHTS STATEMENT

The United States Government has rights in this invention pursuant to Contract No. F33657-88-C-2133 awarded by the Department of the Air Force.

FIELD OF THE INVENTION

This invention relates generally to gas turbine engines and more particularly, to a damper for damping vibration of gas turbine engine structural members.

BACKGROUND OF THE INVENTION

Vibration, a form of wave motion, can develop in structural members of a gas turbine engine as a consequence of relative movement between the engine structural members. This relative movement, or motion, can include rotation of a structural member such as a rotor with respect to a fixed structural member, a co-rotating structural member such as another rotor operating at a different speed, or a counter-rotating structural member such as in a gas turbine engine with counter-rotating turbine rotors. Structural members particularly susceptible to vibration include seals carried on and integral with rotating structures. The seals are usually annular and frequently of thin-walled construction for weight and cost saving reasons, and the seals are used within a gas turbine engine to prevent fluid leakage from one section of the engine to another. Vibration of such structural members includes, for example, circumferentially propagating flexural vibration and axially propagating vibration. Vibration of a structural member can lower engine efficiency due to fluid leakage past seals and can also induce fatigue or cracking of such structural members. It is desirable to reduce, or damp, such vibration in order to maintain engine efficiency and increase the useful life of the structural member.

Damping rings presently are utilized for damping vibration of an annular structural member. The damping effectiveness of a damper ring increases with an increase in distance between the neutral axis/line of the damper ring and the neutral axis of the structural member to be damped. The neutral axis/line of a body is the axis formed by the points of zero stress in the body. On one side of the neutral axis/line, the body is subject to tensile stress, while simultaneously on the other side of the neutral axis, the body is subject to compressive stress. Such stresses within the body become greater as the distance from the neutral axis increases. By increasing the distance between neutral axes, the compressive stresses of the structural member and the tensile stresses of the damper ring at the interface of the structural member and damper ring are also increased. Due to the resulting greater differential between the compressive stresses of the structural member and the tensile stresses of the damper ring, slip is promoted. Slip is the relative tangential movement between the damper ring and the structural member. When the structural member vibrates, the damper ring does not follow the vibration but rather slips tangentially relative to the structural member. As a result of frictional effects, such relative movement produces heat and thereby promotes energy dissipation. By increasing the distance between the neutral axis/line of the damper ring and the neutral axis/line of the structural member to be damped, damping effectiveness is increased.

Known dampers include annular rings located adjacent or almost adjacent the structural member which is to be damped. For example, some structural members include a groove, or ring trap, for receiving the damper ring. This results in the neutral axes of the damper ring and the structural member being relatively close to each other. For example, U.S. Pat. No. 4,361,213, which is assigned to the present assignee and hereby incorporated herein by reference, describes a damper with a cross section of generally U shape. The U shape increases the distance between the damper ring and the structural member to be damped, thus giving the damper greater damping effectiveness, but does not allow flexibility to increase or decrease the distance between neutral axes.

Further, retaining known damper rings in a proper location and position relative to the structural member, while at the same time permitting ease of installation and replacement, is difficult. Although axial movement and radial movement of the damper ring should be prevented, relative tangential movement, or slip, between the damper ring and the structural member should be permitted.

It would be desirable to provide a vibration damper which prevents relative axial and radial movement, yet permits relative tangental movement, between the damper and the vibrating structure. It also would be desirable to provide such a damper which is securely retained in a desired position relative to the vibrating structure yet is easy to install.

SUMMARY OF THE INVENTION

These and other objects may be attained by a damper which, in one form, includes a damper ring having inner and outer radial surfaces, axial retainers extending radially outward from the outer radial surface, and an annular stiffener protruding radially inward from the inner radial surface. The axial retainers prevent disengagement of the damper ring from the structural member. The stiffener adds mass to the damper ring such that the radial distance of the neutral axis of the damper ring from the neutral axis of the structural member is increased, thus increasing damping effectiveness. The stiffener also adds torsional and bending rigidity to the damper ring so that the damper ring is further prevented from disengaging from the structural member.

In one specific embodiment, the damper ring has a generally Y-shaped cross section with the annular stiffener providing the radial portion of the "Y". The axial retainers include a plurality of tabs circumferentially aligned around the damper ring. Alternatively, the axial retainers may include a plurality of tabs circumferentially offset around the damper ring or continuous circumferential extensions.

The stiffener can be of any radial length to achieve desired placement of the neutral axis and thus desired damping effectiveness. The stiffener may further include an extension protruding substantially axially from the stiffener radially inner surface to further increase the distance between the neutral axes of the damper ring and the structural member and thus increase the damping effectiveness of the damper.

The above described damper substantially prevents relative axial and radial movement, yet permits relative tangental movement, between the damper and the vibrating structure. The damper also can be securely retained in a desired position relative to the vibrating structure yet is easy to install.

DETAILED DESCRIPTION

Figure 1:
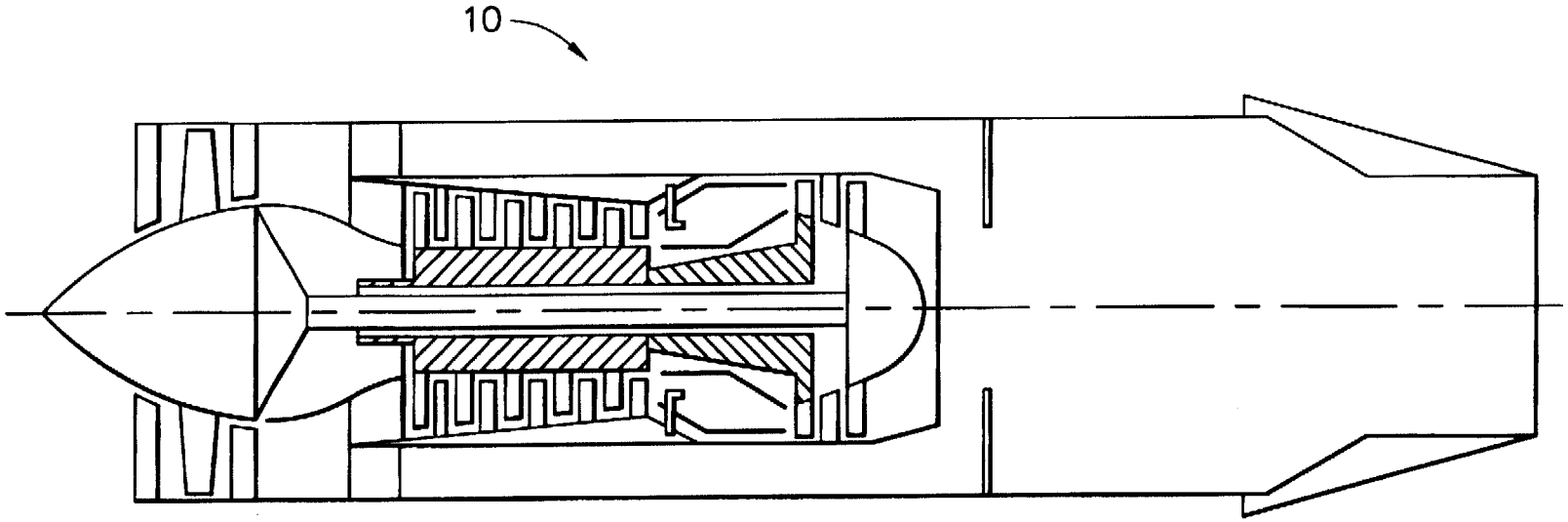
FIG. 1 is a cross sectional-view of a conventional gas turbine engine.

FIG. 1 is a cross-sectional view of a typical gas turbine engine 10 wherein various embodiments of the present invention may be effectively utilized. It is to be understood that while the present invention is described as being used in the turbine section of a gas turbine engine, that section is only one example of a suitable use. The invention is equally applicable for damping vibrations in other sections of a gas turbine engine as well as in other types of machinery wherein vibration is encountered. Also, although the term "flange" frequently is used herein for convenience of understanding, the term "flange" is intended to include within its meaning any extension such as a ridge or protuberance upon which the damper ring may be mounted.

Figure 2:
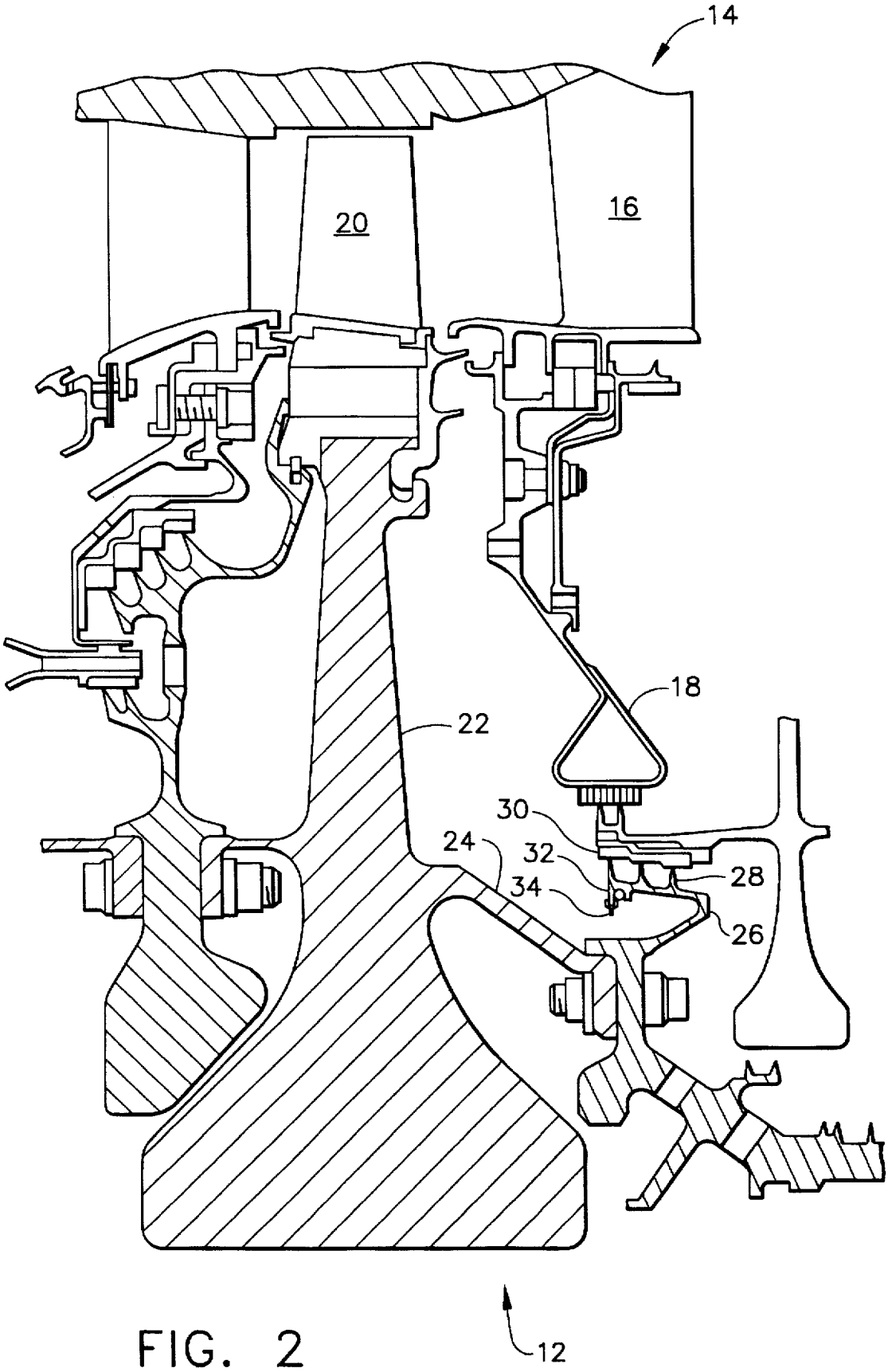
FIG. 2 is a fragmentary cross-sectional view of the upper half of the turbine section of a gas turbine engine incorporating a damper in accordance with one embodiment of the present invention.

FIG. 2 is a fragmentary cross-sectional view of the upper half of the turbine section of a gas turbine engine incorporating a damper in accordance with one embodiment of the present invention. More particularly, gas turbine engine 10, and the turbine section in particular, is symmetrical about the engine longitudinal axis. The turbine section includes a rotor assembly 12 and a stator assembly 14. When the engine is operating, stator assembly 14 remains fixed while rotor assembly 12 rotates relative to stator assembly 14 about the engine longitudinal axis.

Stator assembly 14 includes a plurality of nozzle vanes 16 circumferentially spaced around the turbine and an annular inner shroud assembly 18. Rotor assembly 12 includes a plurality of blades 20 circumferentially spaced around the turbine and joined to an annular rotor disc 22. Extending from various locations on rotor assembly 12 are structural members such as annular shaft 24 and an annular seal 26, all of which rotate with rotor assembly 12 during engine operation.

Annular shaft 24 and seal 26 are secured to rotor assembly 12 by any suitable means, including but not limited to bolting, or alternatively, shaft 24 and seal 26 can be integral with shaft 24. Seal 26 includes annular teeth or serrations 28, each of which is in a sealing relationship with an annular sealing surface 30. The function of each seal 26 is to prevent fluid leakage from one side of the seal to the other. Although both seal 26 and sealing surface 30 are described as being carried on rotating structural members, it is to be understood that the seal can be carried on stationary structural members while the sealing surface can be carried on rotating structural members. Conversely, the seal can be carried on rotating structural members while the sealing surface can be carried on stationary structural members.

Seal 26 also includes a protruding extension or flange 32. Flange 32 can be integral with or can be securely attached to the structural member. Flange 32 is annular and concentric with the structural member from which it extends. For example, annular flange 32 extends from the seal 26. Annular flange 32 can be, for example, a vibration stiffener, a thermal sink, or can have any other desired purpose.

Due to the rotation of rotor assembly 12 and also due to other factors such as pressure variations across seal 26, a form of wave motion known as vibration can develop in the structural members, particularly in the seals. Vibration can be destructive to the engine structural members if left unchecked. Different types of vibration can occur in the structural members, such as, for example, circumferentially propagating flexural vibration and axially propagating vibration. Structural members, such as seal 26, are generally of a thin-walled construction in order to reduce weight and cost. Because of their thin-walled construction, such structural members are particularly susceptible to vibration.

In accordance with one embodiment of the present invention, damper ring 34 is secured to flange 32 to damp vibration of seal 26. It is to be noted that reference to seal 26 in this embodiment is for convenience only as the damper ring may be attached to any protruding extension of any structural member to be damped. Furthermore, although damper ring 34 is described as engaging a flange of a rotating structural member, it can also be successfully employed to damp vibration of a non-rotating structural member.

Figure 3:
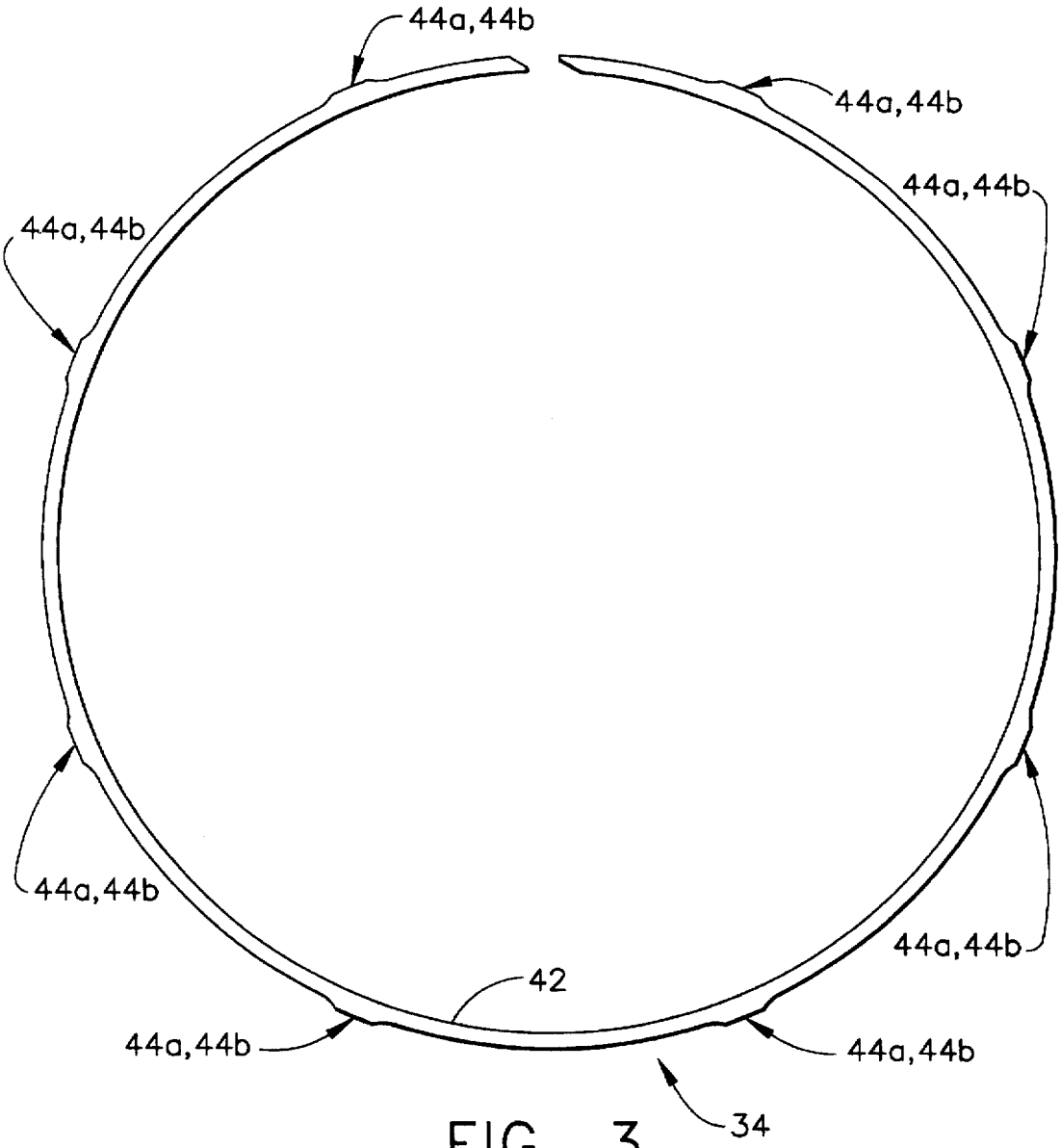
FIG. 3 is a front elevational view in schematic of the damper ring showing the circumferential disposition of aligned tabs.

As shown in FIG. 3, damper ring 34 is annular or circular, and is severed or split. Severing enables diametrical expansion and contraction of damper ring 34. That is, the diameter of damper ring 34 can be decreased by applying forces directed radially inward, and the diameter can be increased by applying forces directed radially outward. This permits ease of installation or replacement. Additionally, severing damper ring 34 allows centrifugal force to expand the diameter of damper ring 34 during rotation sufficiently to retain it radially more securely against rotating structural member 32. Severed ring 34 also has inherent spring tension which assists in retaining ring 34 radially against flange extension 32, particularly when the structural member is not rotating. Damper ring 34 can be fabricated of any material suitable for the environmental conditions to which it will be subjected. When used in a gas turbine engine, fix example, damper ring 34 is preferably fabricated from metallic material.

Figure 4:
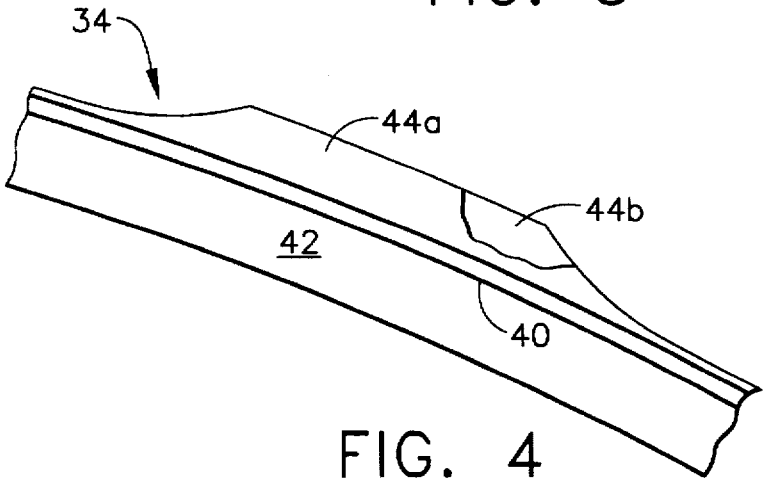
FIG. 4 is a fragmentary front elevational view taken from FIG. 3 of one of the circumferential tabs.
Figure 5:
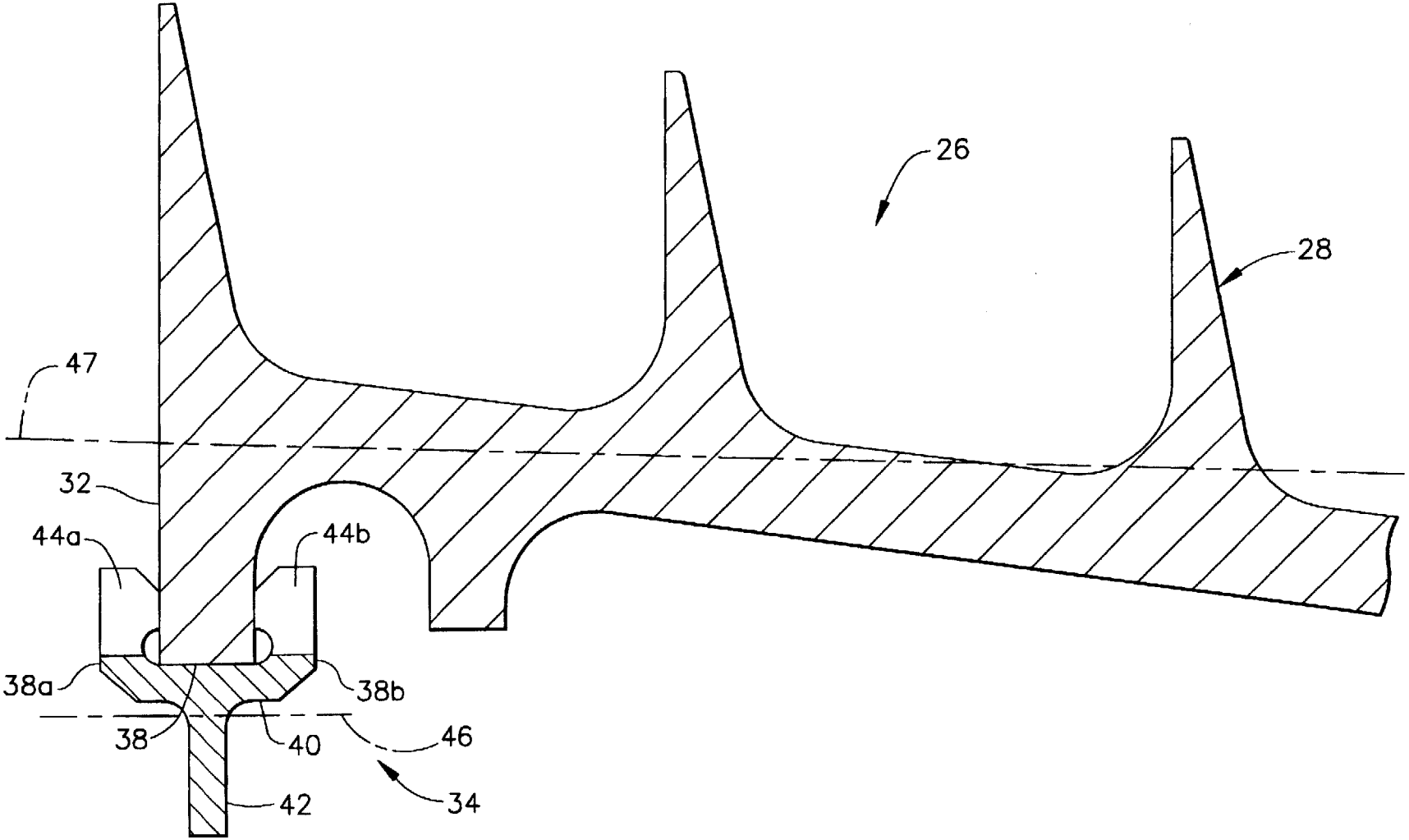
FIG. 5 is a cross-sectional view in the axial-radial plane of the preferred embodiment of the damper ring in assembly with its structural member.

Referring to FIGS. 3, 4 and 5, damper ring 34 can have any desired cross-sectional shape. In one embodiment, damper ring 34 has a generally Y-shaped cross sectional shape with a radially outer surface 38 and a radially inner surface 40. Radially outer surface 38 has a first axial end **38*a* and a second axial end 38*b*. Damper ring 34 is symmetrical and annular, and ring 34 may be installed on flange extension 32 with either first axial end 38*a* or second axial end 38*b* facing in the forward direction. Ring 34** does not, however, have to be symmetrical.

Damper ring 34 further includes a stiffener 42 extending radially inward from radially inner surface 40. Stiffener 42 performs dual functions. Specifically, stiffener 42 increases the torsional and circumferential (bending) rigidity of damper ring 34, thus improving retention of damper ring 34 on flange extension 32. Further, stiffener 42 adds mass to damper ring 34 sufficient to distance neutral axis 46 of damper ring 34 from neutral axis 47 of structural member 26. As indicated earlier, as the distance between the neutral axes 46 and 47 of damper ring 34 and structural member 26 increases, slip and thus damping effectiveness increases. One advantage of the present invention is that stiffener 42 can be manufactured in any length as required to add enough mass to achieve the desired separation between neutral axis/line 46 and 47 and the desired damping effectiveness.

Damper ring 34 further includes at least two axial retainers 44*a* and 44*b* extending radially from outer surface 38. In particular, at least one axial retainer 44*a* extends radially from first axial end 38*a*, and at least one axial retainer 44*b* extends radially from second axial end 38*b*. Axial retainers 44*a* and 44*b* restrict relative axial movement between damper ring 34 and structural member 32.

Figure 6:
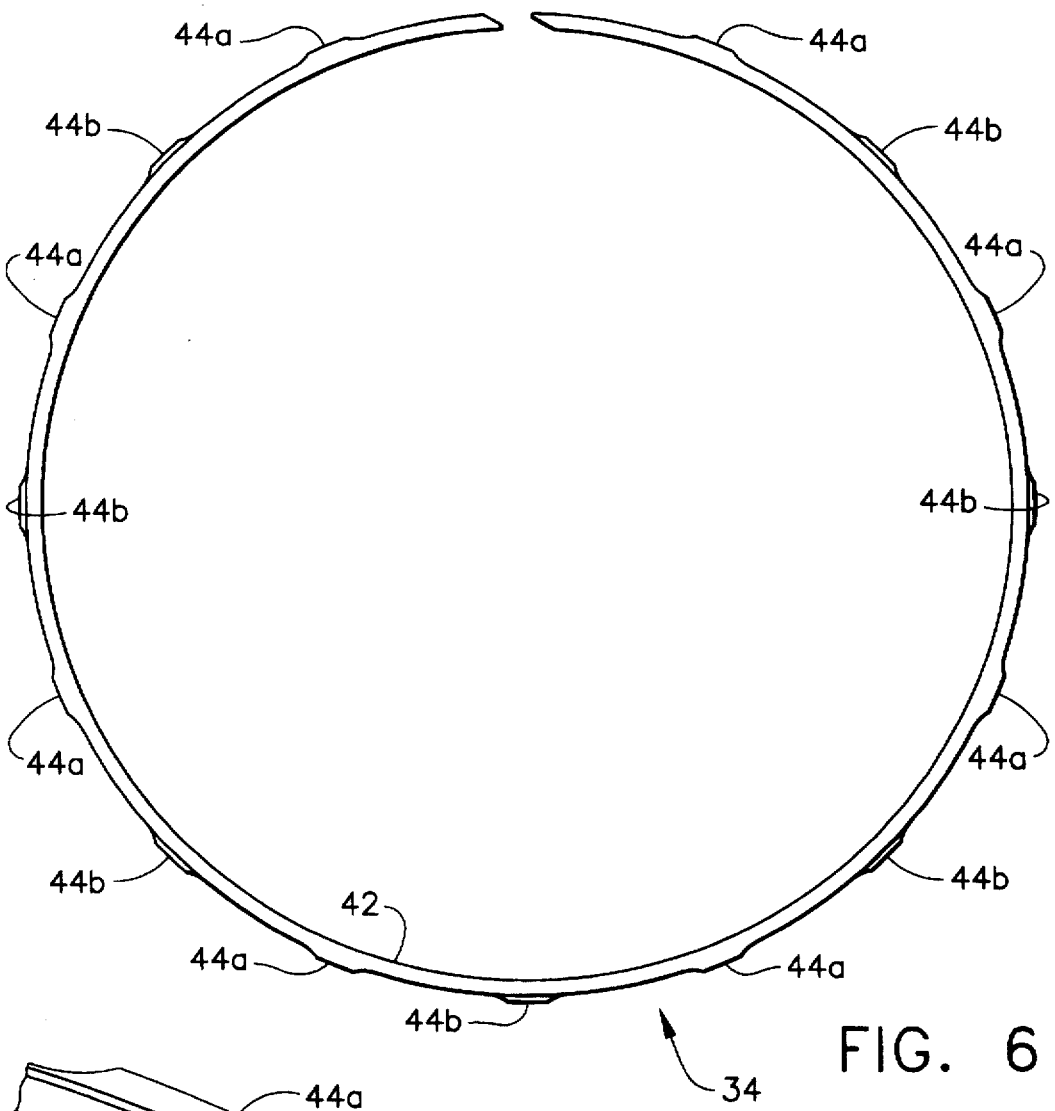
FIG. 6 is a from elevational view in schematic of the damper ring showing the circumferential disposition of offset tabs.
Figure 7:
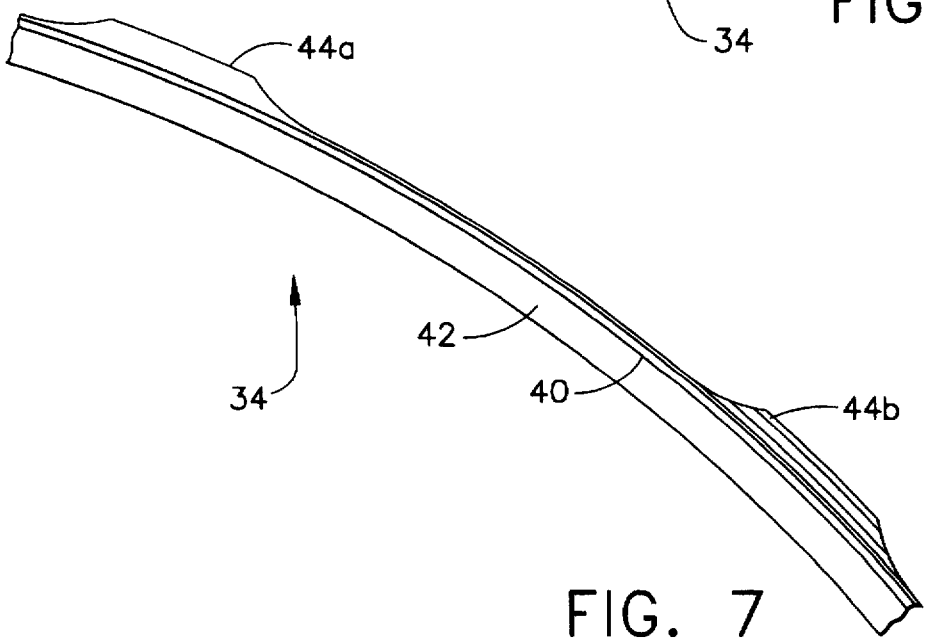
FIG. 7 is a fragmentary front elevational view taken from FIG. 6 of one pair of the offset tabs.

In one form, axial retainers 44*a* and 44*b* include a plurality of aligned tabs spaced circumferentially around damper ring 34 and adjacent the sides of annular flange extension 32. Although eight such pairs of tabs 44 are shown in FIG. 3, the number of tabs 44 can vary as desired. Alternatively, as shown in FIGS. 6 and 7, axial retainers 44*a* and 44*b* may include a plurality of circumferentially offset tabs 44 spaced around damper ring 34. If desired, axial retainers 44*a* and 44*b* may each be a continuous circumferential extension. Also if desired, axial retainers 44*a* and 44*b* can be crimped against the sides of flange extension 32 to provide a greater degree of axial movement restriction. Such crimping would also restrict relative radial movement between damper ring 34 and flange 32. The degree of frictional engagement between flange 32 and axial retainers 44*a* and 44*b* should be such as to optimize slip, as described above.

Figure 8:
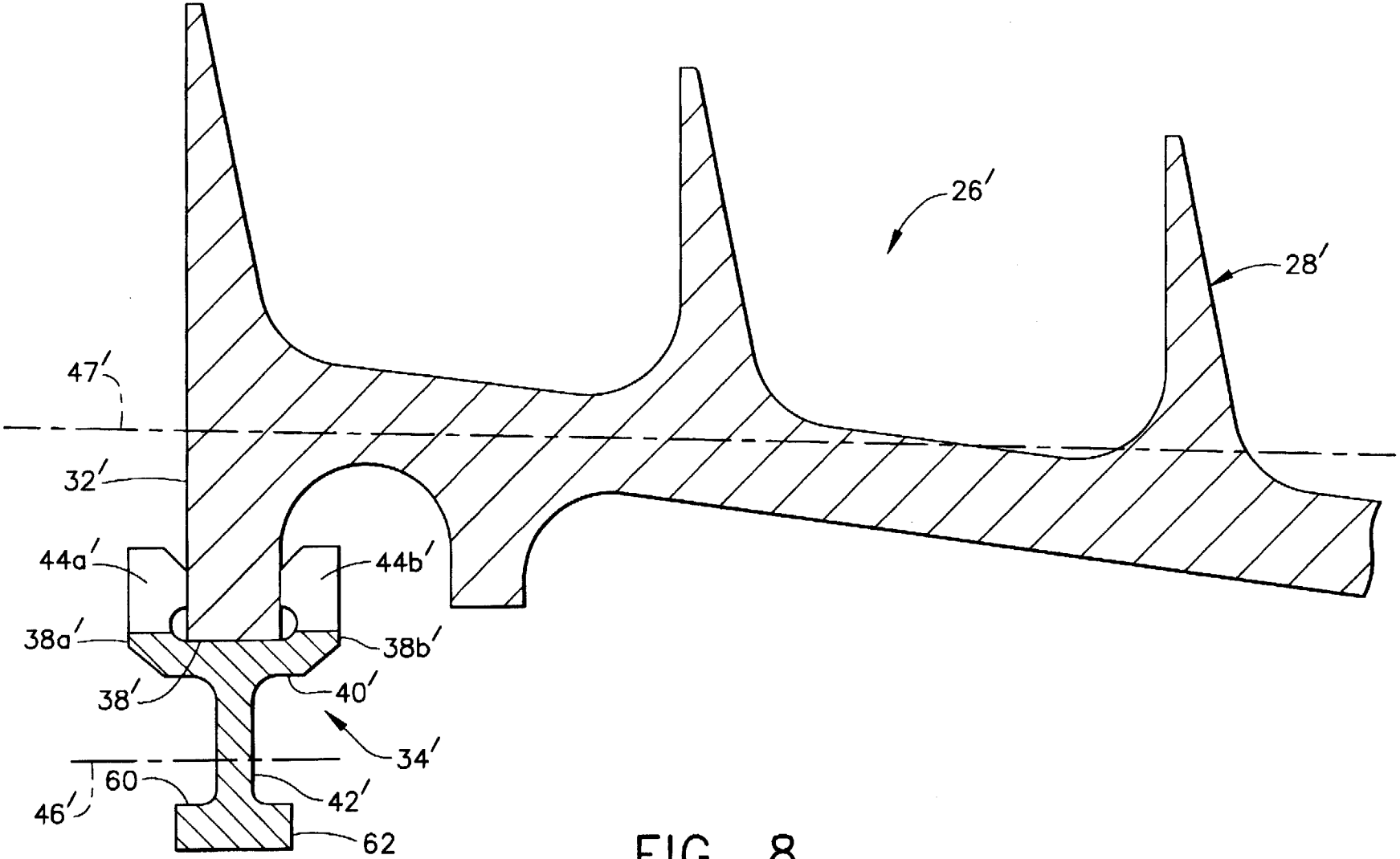
FIG. 8 is a cross-sectional view in the axial-radial plane of an alternative embodiment of the damper ring in assembly with its structural member and exhibiting altered vibration dynamics.

An alternative embodiment of the present invention is shown in FIG. 8. For ease of description, the structural elements shown in the embodiment illustrated in FIG. 8 which are identical (except as noted below) to those elements of the embodiment shown in FIG. 5 are referenced in FIG. 8 using the same reference numeral as used in FIG. 5 with a prime. More specifically, a structural seal 26' has serrations 28' and a flange extension 32' onto which a damper ring 34' is attached. Damper ring 34' includes a radially outer surface 38' with first axial end 38*a*' and second axial end 38*b*', and a radially inner surface 40' with annular stiffener 42' extending radially therefrom. Damper ring 34' further includes axial retainers 44*a*' and 44*b*' extending radially from first and second axial ends 38*a*' and 38*b*' respectively. Further, an annular extension 62 protrudes substantially axially from annular stiffener 42'. Annular extension 62 serves to further increase the mass of damper ring 34', concentrating such mass at the radially inner surface of stiffener 42'. Increasing the mass of damper ring 34' in this way moves the neutral axis 46' of damper ring 34' further radially away from neutral axis 47' of structural member 26'. This radial distancing of the neutral axes further increases the damping effectiveness of damper ring 34' as discussed earlier.

Axial retainers 44*a*' and 44*b*' include a plurality of aligned tabs spaced circumferentially around damper ring 34'. As explained above, axial retainers 44*a*' and 44*b*' may alternatively be continuous circumferential extensions or a plurality of circumferentially offset tabs spaced around damper ring 34'.

The above described dampers substantially prevent relative axial and radial movement, yet permit relative tangental movement, between the damper and the vibrating structure. The dampers also can be securely retained in a desired position relative to the vibrating structure yet are easy to install.

From the preceding description of various embodiments of the present invention, it is evident that the objects of the invention are attained. Although the invention has been described and illustrated in detail, it is to be clearly understood that the same is intended by way of illustration and example only and is not to be taken by way of limitation. Accordingly, the spirit and scope of the invention are to be limited only by the terms of the appended claims.

What is claimed is:

1. A damper for damping vibration of a structural member of a turbine engine, the structural member having a neutral axis and an annular extension, said damper comprising a damper ring comprising a generally axially extending outer surface having first and second axial ends, a generally axially extending inner surface, an annular stiffener extending from said inner surface, at least one first axial retainer extending radially outward from said first axial end of said outer surface, and at least one second axial retainer extending radially outward from said second axial end of said outer surface, said damper ring further comprising an annular extension protruding substantially axially from said annular stiffener, said damper ring having a neutral axis, and said axial retainers adaptable for mounting said damper ring on the annular extension of the structural member so that said neutral axis of said damper ring is radially spaced from the neutral axis of the structural member.

2. A damper in accordance with claim 1 wherein each of said first and second axial retainers comprises at least one extension extending radially outward from said first and second ends respectively.

3. A damper in accordance with claim 2 wherein said first and second axial retainers comprise a pair of continuous circumferential extensions.

4. A damper in accordance with claim 2 wherein said first and second axial retainers comprise a plurality of tabular extensions circumferentially aligned.

5. A damper in accordance with claim 2 wherein said first and second axial retainers comprise a plurality of tabular extensions circumferentially offset.

6. A damper in accordance with claim 1 wherein the structural member annular extension comprises a flange.

7. A damper in accordance with claim 1, wherein said damper ring is severed for enabling diametrical expansion and contraction thereof.

8. A damper for damping vibration of an annular structural member including a neutral axis and an annular flange, said damper comprising a damper ring comprising:

a generally axially extending outer surface having first and second axial ends, a generally axially extending inner surface, an annular stiffener protruding radially inward from said inner surface so that said damper ring is stiffened, an annular extension protruding substantially axially from said annular stiffener, and a plurality of axial retainers comprising a plurality of circumferentially aligned tabular extensions protruding radially outward from said first and second ends of said outer surface so that relative axial movement between said damper ring and the flange is restricted, and said damper ring having a neutral axis and being severed for enabling diametrical expansion and contraction thereof, and said axial retainers adaptable for mounting said damper ring on the annular flange so that the neutral axis of said damper ring is radially spaced from the neutral axis of the structural member.

9. A damper for damping vibration of a structural member of a turbine engine, the structural member having a neutral axis and an annular extension, said damper comprising a damper ring comprising a generally axially extending outer surface having first and second axial ends, a generally axially extending inner surface, and an annular stiffener extending from said inner surface, a length of said annular stiffener selected to provide a preselected separation between neutral axes of the structural member and said damper.

10. A damper in accordance with claim 9 further comprising at least one first axial retainer extending radially outward from said first axial end of said outer surface, and at least one second axial retainer extending radially outward from said second axial end of said outer surface.

11. A damper in accordance with claim 10 wherein each of said first and second axial retainers comprises at least one extension extending radially outward from said first and second ends respectively.

12. A damper in accordance with claim 11 wherein said first and second axial retainers comprise a pair of continuous circumferential extensions.

13. A damper in accordance with claim 11 wherein said first and second axial retainers comprise a plurality of tabular extensions circumferentially aligned.

14. A damper in accordance with claim 11 wherein said first and second axial retainers comprise a plurality of tabular extensions circumferentially offset.

15. A damper in accordance with claim 9 wherein said damper ring further comprises an annular extension protruding substantially axially from said annular stiffener.

16. A damper in accordance with claim 10 wherein the structural member annular extension comprises a flange.

17. A damper in accordance with claim 9 wherein said damper ring is severed for enabling diametrical expansion and contraction thereof.

* * * * *